United States Patent [19]

Erker et al.

[11] Patent Number: 4,711,614

[45] Date of Patent: Dec. 8, 1987

[54] LIFT MAST MOUNTING ARRANGEMENT AND METHOD FOR REMOVAL

[75] Inventors: James W. Erker, Concord; Michael J. Scotese, Willoughby; Jay B. Stotts, Mentor, all of Ohio

[73] Assignee: Caterpillar Industrial Inc., Mentor, Ohio

[21] Appl. No.: 832,495

[22] Filed: Feb. 24, 1985

[51] Int. Cl.[4] ..... B66F 9/08

[52] U.S. Cl. ..... 414/641; 403/15; 403/158; 414/786

[58] Field of Search ..... 414/628–656, 414/786; 187/9 R; 403/15, 157, 158, 162

[56] References Cited

U.S. PATENT DOCUMENTS

| | | | |
|---|---|---|---|
| 2,299,445 | 10/1942 | Weaver | 414/635 |
| 2,720,691 | 10/1955 | Kuniholm | 403/15 X |
| 2,962,180 | 11/1960 | Vossenberg | 414/635 |
| 3,127,956 | 4/1964 | Hosbein et al. | 187/9 R |
| 3,721,318 | 3/1973 | Warrender | 187/9 R |
| 3,782,571 | 1/1974 | Murphy et al. | 414/635 |
| 3,915,324 | 10/1975 | Green et al. | 414/635 |
| 3,999,873 | 12/1976 | Green et al. | 403/152 |
| 4,100,988 | 7/1978 | Hildebrecht | 180/75 |
| 4,126,208 | 11/1978 | McVeen | 187/9 R X |
| 4,126,209 | 11/1978 | Higgins et al. | 187/9 R X |
| 4,164,270 | 8/1979 | Osada et al. | 187/9 R |
| 4,203,684 | 5/1980 | Stecklein | 403/158 |

FOREIGN PATENT DOCUMENTS

| | | |
|---|---|---|
| 1141945 | 12/1962 | Fed. Rep. of Germany . |
| 1275498 | 8/1968 | Fed. Rep. of Germany . |
| 1321 | of 1914 | United Kingdom . |
| 820681 | 9/1959 | United Kingdom . |
| 1246846 | 9/1971 | United Kingdom . |
| 1491473 | 11/1977 | United Kingdom . |

*Primary Examiner*—Robert J. Spar
*Assistant Examiner*—David A. Bucci
*Attorney, Agent, or Firm*—Alan J. Hickman

[57] ABSTRACT

A mounting arrangement for closely connecting a lift mast assembly to a frame member of a work vehicle includes a first apparatus for pivotally connecting a first end portion of lift mast upright guide member to a first shaft, a second apparatus for connecting a first end portion of the first shaft to a first support flange and guiding the first shaft for slidable movement in directions substantially parallel to a wheel spindle axis, and a third apparatus for connecting a second end portion of the first shaft to the vehicle frame member and maintaining the first shaft from slidable axial movement relative to the first support flange. An arrangement for passing pressurized fluid to a location between the first end of the first shaft and a support flange second side is provided to force the first shaft from connection with the first support flange. The mounting arrangement is particularly suited for use on a fork lift truck.

15 Claims, 4 Drawing Figures

III
40
60
36
62
10
52
82
12
56
64
54
70
86
48
66
140
142
130
138
32
98
156
100
166
92
90
96
134
76
94
128
126
120
124
81
30
22
102
129
68
78
72
118
38
74
88
28
26
34
16
18
III
20
24
14

LIFT MAST MOUNTING ARRANGEMENT AND METHOD FOR REMOVAL

TECHNICAL FIELD

This invention relates generally to a mounting arrangement for pivotally connecting a lift mast to a frame, and more particularly to a work vehicle having a lift mast and a mounting arrangement for pivotally connecting the lift mast to a support flange and frame of the work vehicle, and a method for disconnecting the lift mast from the work vehicle.

BACKGROUND ART

Work vehicles for example, lift trucks, typically have a lift mast pivotally mounted on the front end of the vehicle. The lift mast is usually nested between the front wheels of the vehicle and closely adjacent to the vehicle so that the load carrying capacity of the vehicle for a given vehicle weight, is maximized. U.S. Pat. No. 3,915,324, dated Oct. 28, 1975 to Donald A. Green et al., U.S. Pat. No. 3,999,873, dated Dec. 28, 1976 also to Donald A. Green et al., U.S. Pat. No. 4,126,209 dated Nov. 21, 1978 to Robert D. Higgins et al., and U.S. Pat. No. 4,100,988 dated July 18, 1978 to Harold V. Hildebrecht teach mounting arrangements for placing a lift mast between the front wheels of the vehicle and in close proximity to the front of the frames so that the load moment about the center of gravity of the vehicle is kept at a minimim which maximizes the load carrying capacity of the vehicle.

None of the above patents provide a mounting arrangement for connecting a high visibility mast to the vehicle. A high visibility mast is one which has substantially no obstructions disposed between the inner uprights of the mast at a location adjacent to the line of sight of the operator and one in which the inner uprights are tightly nested adjacent respective outer uprights and a substantial distance apart from one another. The reason that none of the above-mentioned patents employ a high visibility mast is that the space available between the vehicle wheels and the design and construction of the mast itself does not permit the use of the mounting arrangements disclosed in the above-noted references. Also, the mounting arrangements of the above-listed patents would not be readily accessible for installation and removal purposes due to the limited amount of space available.

In order to be able to connect or disconnect the lift mast to and from the vehicle, it is necessary to have adequate access to the shaft or pin which pivotally connects the lift mast to the vehicle. None of the mounting arrangements of the prior art provide a mounting arrangement in which the mounting pin or shaft can be successfully removed in this environment. This is primarily due to the fact that the lift jack of the high visibility mast encroaches on the space which was previously usually open and accessible. None of the references make provisions for removal of the mounting shaft in an environment wherein the lift jacks are nested closely adjacent the uprights and not centered between the spaced apart pairs of uprights.

Therefore, it is necessary to provide a pivotal mounting arrangement for a high visibility mast wherein the envelope of the mounting arrangement is kept to a bare minimum and facilitates removal of the mast pivot shaft from connection with the vehicle and/or lift mast.

DISCLOSURE OF THE INVENTION

In one aspect of the present invention, a mounting arrangement for pivotally connecting a lift mast to a vehicle having a frame member is provided. A support flange having first and second opposed sides is connectable at the first side to the vehicle frame member, and a spindle having a first end and a spindle axis is connected at the spindle first end to the support flange second side. A shaft having first and second spaced apart end portions, first and second ends, and a longitudinal axis extending between said shaft first and second ends is provided. A first apparatus pivotally connects a first end portion of a lift mast upright guide member to the shaft, a second apparatus connects the first end portion of the shaft to the support flange and guides the shaft for slidable axial movement in directions substantially parallel to the spindle axis, and a third apparatus connects the second end portion of the shaft to the vehicle frame member and maintains the shaft from slidable axial movement in directions substantially parallel to the spindle axis and relative to the first side of the support flange.

In another aspect of the present invention, a work vehicle has a vehicle frame member having first and second opposed portions, a lift mast having a pair of spaced apart upright guide members, and first and second support flanges having first and second opposed sides. The first support flange first side is connected to the first end portion of the frame member and the second support flange first side is connected to the second end portion of the frame member. First and second spindles each having a spindle axis and a first end are connected at the first end to the second side of the first and second support flanges, respectively. First and second shafts each having first and second spaced apart end portions and first and second spaced apart ends and a longitudinal axis extending between the first and second ends are provided. A first apparatus pivotally connects the first end portion of one of the upright members to the first shaft and the first end portion of the other upright member to the second shaft. The first and second support flanges each have an aperture opening at the first side and the first shaft first end portion is disposed in the aperture of the first support flange and slidably engaged with the first flange surface and the second shaft first end portion is disposed in the aperture of the second support flange and slidably engaged with the second flange surface. First and second support brackets, each having first and second spaced apart sides and an aperture opening at said first and second spaced apart sides are provided. The apertures are defined by a surface and the first shaft second end portion is supportingly engaged with the aperture defining surface of the first support bracket and the second shaft second end portion is supportingly engaged with the aperture defining surface of the second support bracket. A first fastener connects the first shaft second end portion to the first support bracket and a second fastener connects the second shaft second end portion to the second support bracket. The first and second fasteners maintain the first and second shafts, respectively, from movement along their axis and relative to the first and second support flanges.

The method of an embodiment of the present invention includes the steps of supporting the lift mast assembly, removing a first fastener from connection with a first shaft and a first support bracket, removing a second fastener from connection with a second shaft and a second support bracket, connecting a source of pressurized fluid flow to a first fitting mounted on the first shaft, directing pressurized fluid flow from the source to an aperture disposed in a first support flange and urging the first shaft to move in a direction substantially along an axis of the first shaft, towards the first support brackets, and to a location at which the first end portion of the first shaft is free from being disposed in the aperture and free from engagement with a surface defining the aperture, connecting the source of pressurized fluid to a second fitting mounted on the second shaft, directing pressurized fluid flow from the support source to an aperture disposed in a second support flange and urging the second shaft to move in a direction substantially along an axis of the second shaft, toward the second support bracket, and to a location at which the first end portion of the second shaft is free from being disposed in the aperture of the second support flange and free from engagement with a surface defining the aperture, and removing the lift mast from the work vehicle.

BEST MODE FOR CARRYING OUT THE INVENTION

Figure 1:
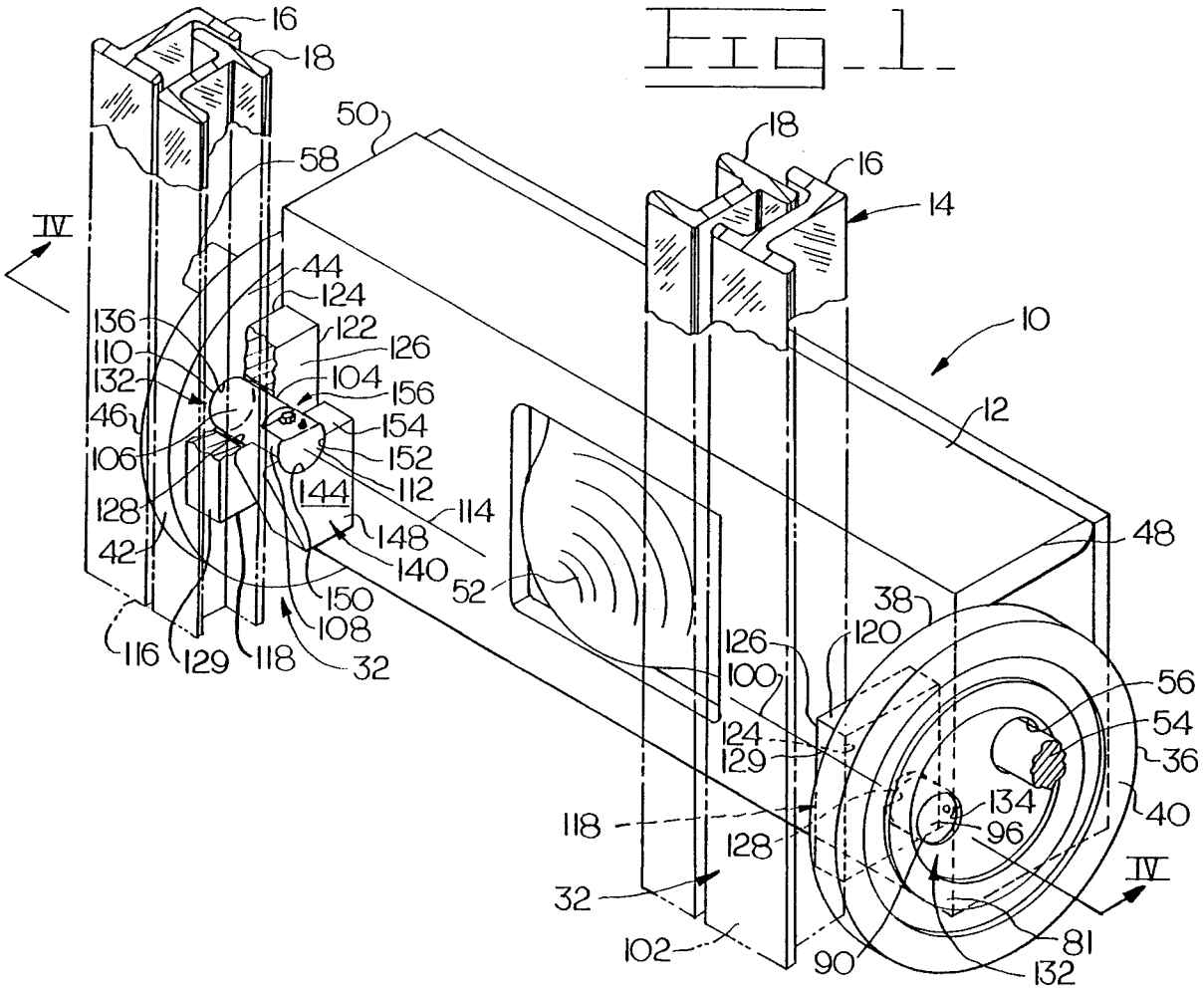
FIG. 1 is a partial diagrammatic isometric view of an embodiment of the present invention showing a front portion of a frame member, lift uprights of a lift mast assembly, portions of a drive axle assembly, and a mounting arrangement for pivotally connecting the lift mast assembly to the vehicle frame.
Figure 2:
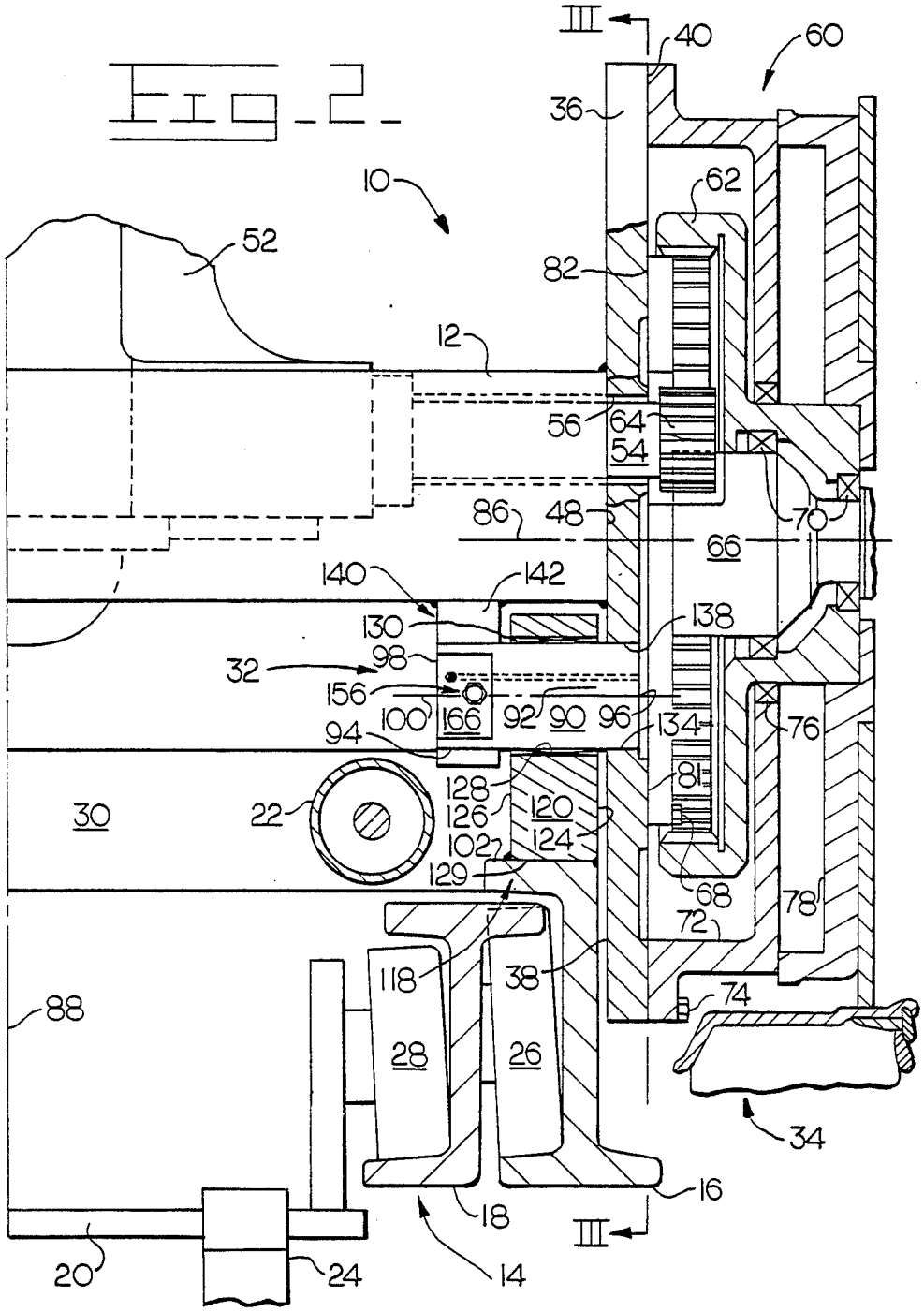
FIG. 2 is a partial enlarged diagrammatic top elevational view of FIG. 1 having portions broken away for clarity and showing in greater detail a portion of the lift mast assembly, the mounting arrangement, and the frame member, including the first support flange and a portion of the spindle.

With reference to the drawings and particularly FIGS. 1 and 2, a work vehicle 10 has a frame member 12 and a lift mast assembly 14 which is pivotally connected to the frame member. The work vehicle 10 is preferably a lift truck; however, other vehicles suitable for mounting a lift mast assembly thereon are to be considered within the field of usage. The lift mast assembly 14 is of the high visibility type and has first and second pairs of spaced apart upright guide members 16,18. Referring to FIG. 2, the lift mast assembly 14 has a carriage 20, a pair of spaced apart lift jacks 22 (only one shown), and a pair of forks 24 (only one shown). The second pair of upright guide members 18 is mounted on and between the first pair of upright guide members by rollers 26 and elevationally movable relative to the first pair of upright guide members 16. The carriage 20, upon which forks 24 are mounted in any conventional or suitable manner, is connected to the second pair of spaced apart upright guide members by rollers 28 and elevationally movable relative to the second pair of upright guide members 18.

In order for lift mast assembly 14 to be categorized as the high visibility type, the viewing window for the vehicle operator, which is defined by the space between the second pair of upright guide members 18, must be substantially clear of obstructions by other mast components. Therefore, lift jacks 22 are positioned substantially behind the upright guide members 16,18 and in a location so that a line of sight of the vehicle operator is not obstructed by the lift jacks 22.

Lift jacks 22 are operatively connected to and between the first and second pairs of uprights in any suitable and customary manner. Telescopic movement of the lift jacks 22 will cause elevational movement of the second pair of uprights 18 relative to the first pair of uprights 16. A lift chain and sheave arrangement (not shown) is operatively connected to the lift mast assembly 14 in a usual and customary manner and to the carriage 20 and first pair of uprights 16. The aforementioned telescopic movement of the lift jacks 22 will also result in elevational movement of the carriage 20 through the chain and sheave arrangement, in a conventional manner. It should be noted that the chain and sheave arrangement as well as fluid carrying hoses, brackets, and the like (all not shown) must be spaced from the window of the lift mast and out of the line of sight of the vehicle operator. Thus, the chain and sheave arrangements, fluid carrying hoses, and brackets and the like must be disposed at a location closely nested adjacent the first and second pairs of uprights 16, 18.

As best seen in FIG. 2, a tie member 30 serves as a connector and spacer for the first pair of upright guide members 16, and a support base for the lift jacks 22. It is to be noted that the placement of the lift jacks 22 behind the upright guide members 16,18 reduces the amount of open and available space normally provided between the frame member 12 and the uprights of the lift mast assembly 14.

A mounting arrangement 32 is provided for pivotally connecting the lift mast assembly 14 to frame member 12. Specifically, the mounting arrangement 32 pivotally connects each of the upright guide members of the first pair 16 to frame member 12 at a location closely adjacent the frame member 12 and vehicle wheels 34. It is extremely important that each upright of the first pair of upright guide members is closely adjacent an end of the work vehicle (frame member 12) and a respective one of the pair of the vehicle wheels 34. The distance from the front of the vehicle to the lift mast assembly 14 will determine the load moment, and the distance between the second pair of upright guide members 18, which is limited by the distance between the vehicle wheels 34, will determine the maximum amount of visibility for the vehicle operator. Placing the mast assembly 14 in front of, over, or outside the wheels 34 is inappropriate since it will adversely affect vehicle maneuverability and operation.

As best seen in FIG. 2, the mounting arrangement 32 has a first support flange 36 which has first and second sides 38,40, and a second support flange 42 which has first and second sides 44,46 (see FIG. 1). The first support flange first side 38 is connected to a first end portion 48 of the frame member 12 and the second support flange first side 44 is connected to the second end portion 50 of the frame member 12 (see FIG. 1). Preferably, frame member 12 is a rectangularly shaped box like structure and the first and second end portions are at locations adjacent opposite sides of the vehicle 10. The frame member 12 is suited for mounting a differential 52 within the box like structure. A first jack shaft 54 extends from the differential 52 past the first end portion 48 of the frame member and through an aperture 56 disposed in an opening on the first and second sides 38,40 of the support flange. Similarly, a second jack shaft 58 extends from the differential 52 past the second end portion 50 of the frame member 12 and through an aperture (not shown) disposed in the second support flange 42 and opening at the first and second sides 44,46 thereof.

With reference to FIG. 2, a first wheel drive arrangement 60 has a ring gear 62 which is engaged with a pinion gear 64 mounted on the first jack shaft 54. The ring gear 62 is rotatably mounted on a first spindle 66 which is secured to the second side 40 of first support flange 36 in any suitable fashion, such as by fasteners 68. A pair of anti-friction bearings 70 support the ring gear 62 for rotation on the first spindle 66 in a conventional manner. The pinion gear 64 transmits rotary motion and power from the first jack shaft 54 to the ring gear 62. A cover 72 is secured to the second side 40 of the first support flange 36 in any suitable fashion such as by threaded fasteners 74. The cover overlies the ring gear 62 and includes a seal 76 for preventing lubricant from leaking from the area disposed between the cover 72 and first support flange 36. A brake drum 78 of conventional design is secured to the ring gear 62 for rotation therewith. Wheel 34 is secured to the brake drum 78 in a usual and customary manner. It is to be noted that an equivalent second wheel drive arrangement (not shown) is mounted on the second side 46 of the second support flange 42 for transmitting rotary motion from the second jack shaft 58 to the other wheel of the pair of wheels 34.

A second spindle 80 (FIG. 4) is connected to the second side 46 of the second support flange 42 in any suitable manner, for example, by threaded fasteners 68. The first and second support flanges 36 and 42 each have annular flanges 81 for mounting and sealing purposes with the first and second spindles 66 and 80. A first end surface 82 of the first spindle 66 is engaged with the second side 40 of the first support flange 36 at the annular flange 81 and connected thereto by fasteners 68 so that a tight seal is provided. Similarly, a first end surface 84 of the second spindle 80 is sealingly engaged with the second side 46 of the second support flange 42 at the annular flange 81 and connected thereto by fasteners 68. The first and second spindles 66 and 80 each have an axis 86 about which the wheels 34 rotate. The axis 86 is oriented transverse of a longitudinal vehicle axis 88 and preferably normal to the axis 88.

With reference to FIGS. 1 and 2, a first shaft 90 having first and second spaced apart end portions 92,94 and first and second ends 96,98 and a longitudinal axis 100 extending between the shaft first and second ends is provided for pivotally connecting a first end portion 102 of one of the uprights of the first pair 16 to the frame member 12. Similarly, a second shaft 104 having first and second spaced apart end portions 106,108 and first and second spaced apart ends 110,112 and a longitudinal axis 114 extending between the first and second ends 110,112 is provided for pivotally connecting a first end portion 116 of the other upright of said first pair of uprights 16 to the frame member 12.

A first means 118 is provided for pivotally connecting the first upright end portion 102 to the first shaft 90 and the first end portion 116 to the second shaft 104. The first means preferably includes first and second blocks 120,122 each having first and second spaced apart sides 124,126 and a bore 128 opening at said first and second sides 124,126. The first block 120 is rigidly secured at one end 129 to the first upright first end portion 102 and the second block 122 is rigidly secured at one end 129 to the first end portion 116 of the other upright guide member of the first pair 16. The first shaft 90 is disposed in bore 128 of the first block 120 so that the first and second ends 96,98 of the first shaft 90 extend past the first and second sides 124,126 respectively of the first block. In a similar manner, the second shaft 104 is disposed in the bore 128 of the second block 122 with the first and second ends 110,112 of the second shaft extending beyond the first and second sides 124,126 respectively of the second block 122. Preferably, a bearing 130 (FIGS. 2 and 4) is disposed in bore 128 in each of the first and second blocks 122,124. The bearings 130 engage the first and second shafts 90,104 and enables the lift mast to be pivoted about the shaft axis 100,114 without causing wear of the first and second blocks 120,122 or first and second shafts 90,104. It is to be noted that the bores 128 and shafts 90,104 could be heat treated so that anti-friction bearings 130 would not be required.

Figure 4:
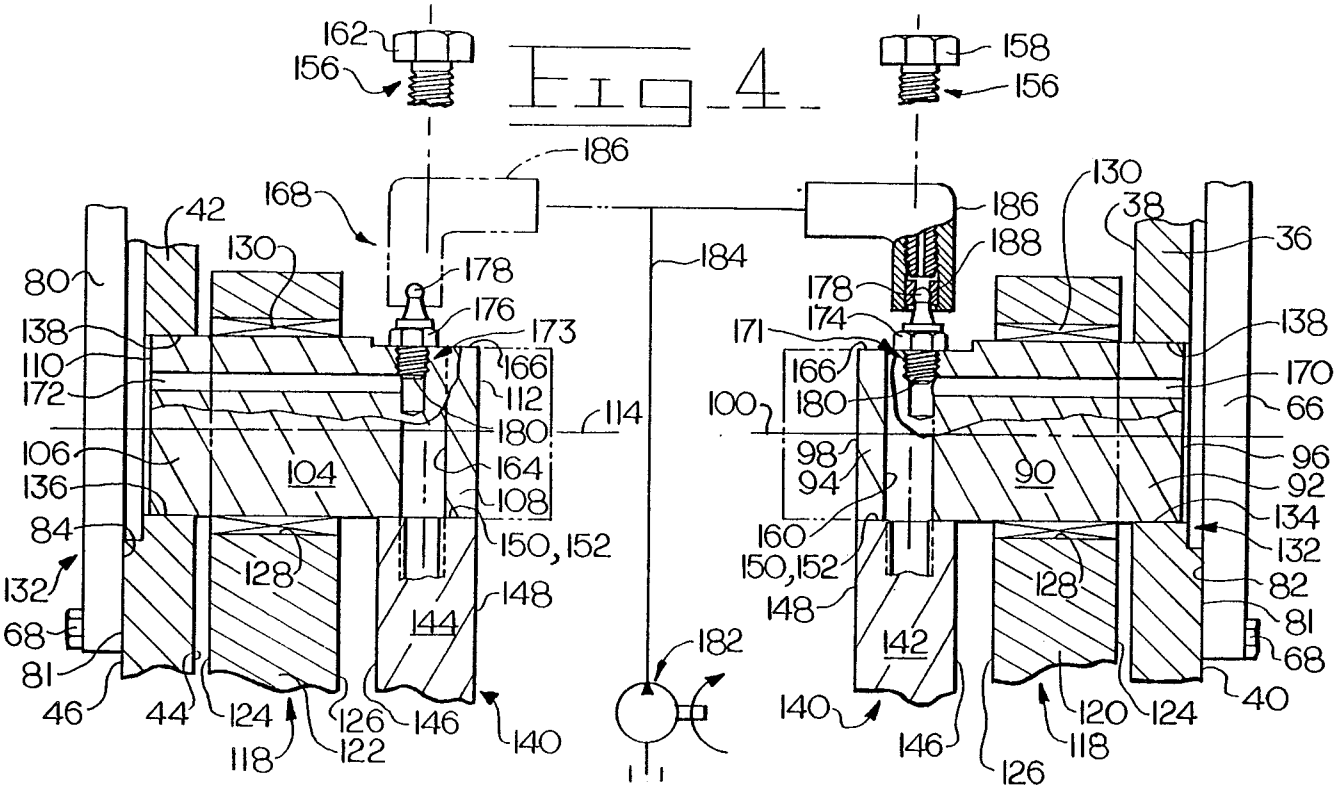
FIG. 4 is a partially exploded diagrammatic cross-sectional view taken along lines IV—IV of FIG. 1 showing the mounting arrangement, first and second passages in the first and second shafts, respectively, first and second fluid connections, and a fluid operated system connectable to the fittings for providing pressurized fluid flow to force the first and second shafts toward disconnected positions shown in phantom.

As best seen in FIG. 4, a second means 132 is provided for connecting the first end portion 92 of the first shaft 90 to the first support flange 36 and for guiding the first shaft 90 for slidable axial movement along its axis 100 and in directions substantially parallel to the axis 86 of the first spindle 66 and for connecting the first end portion 106 of the second shaft 104 to the second support flange 42 and guiding the second shaft 104 for slidable movement along its axis 114 in directions substantially parallel to the axis 86 of the second spindle 80. Preferably, the second means 132 includes a first aperture 134 disposed in the first support flange 36 at a preselected radial location spaced from the axis 86 of the first spindle 66 and a second aperture 136 disposed in the second support flange 42 at a preselected radial distance spaced from the axis 86 of the second spindle 80. Preferably, the first and second apertures 134,136 are located in front of the frame member 12 and between the frame member 12 and the lift mast assembly 14. The first aperture 134 preferably extends through the first support flange 36 and opens at the first and second sides 38,40 thereof. Similarly, the second aperture 136 is disposed through the second support flange 42 and opens at the first and second sides 44,46 of a second support flange 42. Each of the first and second apertures 134,136 are defined by a cylindrical surface 138. The cylindrical surface 138 of the first aperture 134 supports the first end portion 92 of the first shaft 90 and preferably slidably guides the first end portion for axial movement relative to the spindle axis 86. Similarly, the cylindrical surface 138 of the second aperture 136 engages the first end portion 106 of the second shaft 104 and guides the second shaft 104 for slidable axial movements in directions parallel to the axis 86. The first end portion 92 of the first shaft has a cylindrical outer surface having a diameter of a preselected magnitude and the cylindrical surface 138 of the first aperture 134 has a diameter of a magnitude equal to or greater than the diameter of the first end portion 92 of the first shaft 90. Likewise, the diameter of the cylindrical surface 138 defining the second aperture 136 has a diameter of a preselected magnitude and the diameter of the cylindrical outer surface of the first end portion 106 of the second shaft 104 has a diameter equal to or smaller in magnitude than the magnitude of the second aperture 136. The fit between the first and second apertures 134,136 and the first and second shafts 90,104, respectively, is important to the operation and life of the mounting arrangement 32 and also important to removal of the first and second shafts 90,104 and the lift mast assembly 14.

Figure 3:
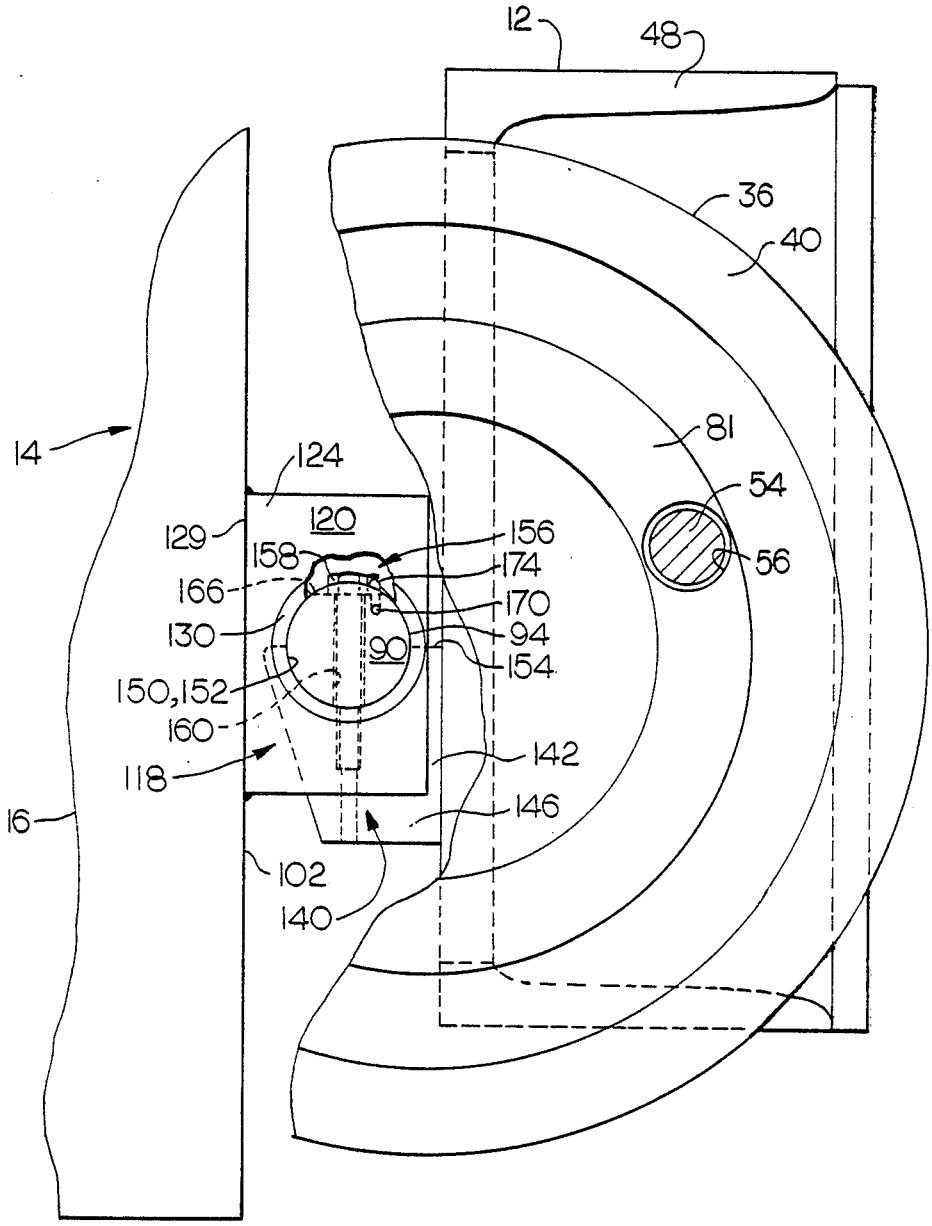
FIG. 3 is a side view taken along lines III—III of FIG. 2 showing the mounting arrangement, one of the first lift mast uprights, the first support flange, and frame member, in greater detail.

A third means 140 is provided for connecting the second end portion 94 of the first shaft 90 to the vehicle frame member 12 and maintaining the first shaft from slidable axial movement in directions substantially parallel to the spindle axis 86 and relative to the first side 38 of the first support flange, and for connecting the second end portion 108 of the second shaft 104 to the vehicle frame member 12 and maintaining the second shaft 104 from slidable axial movement in directions substantially parallel to the spindle axis 86 and relative to the first side 44 of the second support flange 42. Preferably, the third means includes first and second support brackets 142,144 each having first and second spaced apart sides 146,148 and an aperture 150 opening at the first and second spaced apart sides 146,148 of each of the support brackets 142,144. As best seen in FIGS. 1 and 3, the apertures 150 are defined by a surface 152 which is cylindrically configured. In addition to the aperture 150 opening at the first and second sides of the support brackets 142,144, it also opens at an upper end portion 154 of the first and second support brackets 142,144. The second end portion 94 of the first shaft 90 is disposed in the aperture 150 of the first support bracket and in contact with the surface 152 thereof. Similarly, the second end portion 108 of the second shaft 104 is disposed in the aperture 150 of the second support bracket 144 and engageable with the surface 152. It is to be noted that the second end portions 94,108 are cradled by the cylindrical surface 152 and supported by the first and second brackets so that axis 100 and 114 of the first and second shafts 90,104 are parallel to the axis 86 of the first and second spindles 66 and 80. Thus, pivotal movement of the lift mast about the first and second shafts 90,104 will be free from undesirable loading caused by improper axial alignment of the shafts relative to one another.

As best seen in FIG. 4, the third means 140 also includes means 156 for fastening the second end portion 94 of the first shaft 90 to the first support bracket and for fastening the second end portion 108 of the second shaft 104 to the second support bracket 144. Preferably, the fastening means 156 includes a first fastener 158 which is disposed in a radially extending bore 160 in the second end portion 94 of the first shaft and screwthreadably engaged in a threaded aperture in the first support bracket and a second fastener 162 disposed in a radially extending bore located at the second end portion 108 of the second shaft 104 and screwthreadably engaged in a threaded bore disposed in the second support bracket 144. It is to be noted that each of the first and second shafts 90,104 have a flat cutout surface 166 against which the first and second fasteners 158,162 bear. Thus, the first and second fasteners 158,162 maintain and prevent the first and second shafts 90,104 from movement along axis 100,114, respectively, and relative to first and second support flanges 36,42. The distance between the first side 146 of the first support bracket 142 and the first side 38 of the first support flange 36 must be smaller in magnitude than the length of the first shaft 90 in order to mount the first shaft 90. Also, this distance must be greater in magnitude than the distance between sides 124 and 126 of block 120 to permit straddling thereof. For the same reasons, the distance between the first side 146 of the second support bracket 142 and the first side 44 of the second support flange 42 must be smaller in magnitude than the length of the second shaft 104 and greater in magnitude than the width of block 122.

Mounting arrangement 32 enables the lift mast assembly to be mounted closely adjacent the vehicle frame 12 at the front of the vehicle 10 and closely adjacent the first and second support flanges 38,42 so that a high visibility lift mast assembly may be utilized.

Because the first block 120 is positioned between the first support flange 36 and the first support bracket 142 and the second block 122 is positioned between the second support flange 42 and the second support bracket 144, access to the first and second shafts 90,104 for removal purposes is extremely difficult. To facilitate ease of removal of the first and second shafts from engagement with the first and second apertures 134,136, respectively, means 168 is provided. Means 168 passes pressurized fluid flow into said first and second apertures 134,136 at a location between the first end 96 of the first shaft 90 and the second side 40 of the first flange 36, and the first end 110 of the second shaft 104 and the second side 46 of the second support flange 42.

The passing means 168 preferably includes a first passage 170 disposed in the first shaft 90 and opening at the first end 96 and opening at a location 171 spaced from the first end 96, and a second passage 172 disposed in the second shaft 104 and opening at the first end 110 and at a location 173 spaced from the first end 110. A pair of fittings 174,176 each having an inlet end portion 178 and an outlet end portion 180 are adapted to pass fluid from the inlet end portion 178 to the outlet end portion 180. The outlet end portion 178 of the first fitting 174 is connected to the first shaft 90 at the location of the opening 171 from the first end 96, and the outlet end portion 180 of the second fitting 176 is connected to the second shaft 104 at the location of the opening 173 spaced from the first end 110 of the second shaft 104. Fittings 174 and 176 are suitable for passing pressurized fluid delivered from a source of pressurized fluid flow 182, for example, a gear pump, piston pump, vane pump, grease gun, and the like to passages 170 and 172, respectively. Source 182 directs pressurized fluid flow to a selected one of the first and second fittings 174,176 via a conduit 184 and a connector 186. The connector 186 is positionable on the inlet end portion 178 of either of the first and second fittings 174,176 and retained thereon by a pair of jaws 188 which are biased in an inward direction. The first end 82 of the first spindle 66 covers the first aperture 134 of the first support flange 36. Because of the tight seal between the spindle first end 82 and the support flange second side 40, fluid pressure at the first end 96 of pin 90 will be able to be built up. Similarly, the tight seal between the first end 84 of second spindle 80 and second side 46 will permit pressure to be built up at the first end 110 of the second shaft 104. Introduction of pressurized fluid flow to the sealed area at the first ends 96 and 110 will cause the first and second shafts 90,104 to move in the direction towards one another, along their axis 100,114, and towards the first and second support brackets 142,144, respectively.

INDUSTRIAL APPLICABILITY

With reference to the drawings, and particularly those of FIGS. 1, 2, and 3, the mounting arrangement 32 provides a unique, simple, and efficient way of pivotally connecting the lift mast assembly 14 to the frame 12 of the vehicle 10. Because the first and second support flanges 36,42 and the cylindrical surface 138 of the first and second apertures 134,136 provide support and guidance for the first and second shafts 90,104, the ability to utilize a high visibility mast and improve visibility for the vehicle operator is made possible. The first and second support brackets 142,144 and the fastening means 156 retains the first and second shafts 90,104 at the desired location with respect to the first and second support flanges 36,42 and permits ease of release of the second end portions 94,108 of the first and second shafts 90,104 for removal purposes.

A method for disconnecting the lift mast assembly 14 from the work vehicle 10 is provided. First, the lift mast assembly is supported from tipping and elevational movement by an overhead hoist or the like. Then the first fastener 158 is screwthreadably removed from connecting the first shaft 90 to the first support bracket 142, and the second fastener 162 is screwthreadably removed from connecting the second shaft 104 to the second support bracket 144 in any suitable manner such as with a wrench. The source of pressurized fluid flow 182 is connected to the first fitting 174 mounted on the first shaft 90. Pressurized fluid flow from the source 182 is directed (such as by opening a valve, actuating the pump 182, or the like) to aperture 134 disposed in the first support flange 36 which urges the first shaft 90 to ove along axis 100 toward the first support bracket 142, and to a location at which the first end portion 92 of the first shaft 90 is free from being disposed in the first aperture 134 and free from engagement with a surface 138. The source 182 is then connected to the second fitting 176 mounted on the second shaft 104. Pressurized fluid flow is then directed from the source 182 to the second aperture 136 disposed in the second support flange 42. The fluid pressure urges the second shaft 104 to move in a direction substantially along axis 114 towards the second support bracket 144, and to a location at which the first end portion 106 of the second shaft 104 is free from being disposed in the second aperture 136 and free from engagement with the surface 138 of aperture 136. The lift mast assembly 14 is then removed from the work vehicle 10 such as by the hoist.

It should be noted that the passing means 168 enables the first and second support flanges 36,42 to be used to support the first and second shafts 90,104. This is permitted because of the unique method by which the first and second shafts 90,104 are removed. Without this unique removal technique, one would not be able to find adequate space to remove the first and second shafts because of their close proximity to frame member 12, the lift mast uprights 16,18, and the vehicle wheels 34.

Thus, it can be seen that the mounting arrangement 32 permits the use of a high visibility mast on a smaller and/or narrower vehicle than usual while maximizing the load carrying capacity of the vehicle due to the closeness of the lift mast to the frame 12 and wheels 34 of the work vehicle 10.

It should be also noted that the fastening means 156 positively retains the first and second shafts 90,104 and eliminates the potential of inadvertent loosening of the first and second shafts 90,104.

Other aspects, objects, and advantages of this invention can be obtained from a study of the drawings, the disclosure, and the appended claims.

We claim:

1. A mounting arrangement for pivotally connecting a lift mast assembly to a vehicle having a frame member, comprising:

a support flange having first and second opposed sides, and being connected at said first side to the frame member;

a spindle having a first end, a spindle axis, and being connected at the first end to the support flange second side;

a lift mast upright guide member having a first end portion;

a shaft having first and second spaced apart end portions, first and second ends, and a longitudinal axis extending between said shaft first and second ends;

first means for pivotally connecting the first end portion of the lift mast upright guide member to the shaft;

second means for connecting the first end portion of said shaft to the support flange and guiding said shaft for slidable axial movement in directions substantially parallel to said spindle axis, said second means including an aperture disposed in said support flange and opening at the first and second sides of the support flange, said shaft first end portion being disposed in said aperture and slidably engaged with a surface defined by said aperture in said support flange, said spindle first end being positioned in a covering and closing relationship relative to the support aperture opening at said flange second side;

third means for connecting the second end portion of said shaft to said frame member and maintaining said shaft from slidable axial movement in said directions substantially parallel to the spindle axis and relative to the first side of the support flange.

2. The mounting arrangement, as set forth in claim 1, wherein the surface of said aperture defines a cylindrically shaped bore having a diameter of a preselected magnitude, said shaft first end portion having a cylindrical outer surface and an outer diameter of a preselected magnitude, said bore diameter being at least equal in magnitude to the magnitude of the outer diameter of the shaft first end portion.

3. The mounting arrangement, as set forth in claim 1, including means for passing pressurized fluid into said aperture at a location between the first end of said shaft and said flange second side, said fluid being adapted to force, said shaft from said aperture in a direction substantially along the shaft axis.

4. The mounting arrangement, as set forth in claim 3, wherein said passing means includes a passage disposed in said shaft and opening at said shaft first end and at a location spaced from said shaft first end.

5. The mounting arrangement, as set forth in claim 4, including a fitting having an inlet end portion and an outlet end portion and being adapted to pass fluid from said inlet end portion to said outlet end portion, said outlet end portion being connected to said shaft at the opening spaced from the shaft first end and open to said passage.

6. The mounting arrangement, as set forth in claim 1, wherein said third means includes:

a support bracket having first and second spaced apart sides and an aperture opening at said bracket first and second sides, said support bracket aperture being defined by a surface and said support bracket surface being engaged with the second end portion of the shaft, said support bracket surface being at a preselected location relative to the first side of the support flange and at a location at which the surface of the support bracket and the apertures defining surface of support flange support the shaft so that the axis of the shaft is maintained parallel to the axis of the spindle; and fastening means for connecting the second end portion of the shaft to the support bracket.

7. The mounting arrangement, as set forth in claim 6, wherein said support bracket has an upper end portion extending between said first and second bracket sides and said support bracket aperture opening at said upper end portion, said shaft having an aperture disposed in and extending through the shaft second end portion, and said fastening means including a fastener said fastener being positioned in said aperture at the shaft second end portion and screwthreadably connected to the support bracket.

8. The mounting arrangement, as set forth in claim 6, wherein said first means includes a block having first and second spaced apart sides and a bore opening at said first and second sides, said block being rigidly secured to the first end portion of the upright guide member and said shaft being disposed in the bore of said block, said block being positioned on said shaft at a location between the support flange and the support bracket.

9. The mounting arrangement, as set forth in claim 8, wherein said first means includes a bearing disposed in the bore of said block and said shaft being rotatably disposed in the bearing.

10. A work vehicle, comprising:

a frame member having first and second spaced apart opposed end portions;

a lift mast assembly having a first pair of spaced apart upright guide members, said upright guide members each having a first end portion;

first and second support flanges each having first and second opposed sides, said first support flange first side being connected to the first end portion of said frame member, and said second support flange first side being connected to the second end portion of said frame member, said first end portion of the upright guide members being disposed between the first and second support flanges and closely adjacent the frame member, one of the upright guide members being closely adjacent the first support flange and the other one of the guide members being closely adjacent the second support flange;

first and second spindles each having a spindle axis and a first end, said first spindle first end being connected to the first support flange second side and said second spindle first end being connected to the second support flange second side;

first and second shafts each having first and second spaced apart end portions, first and second spaced apart ends, and a longitudinal axis extending between said first and second ends;

first means for pivotally connecting the first end portion of one of the upright members of the first pair to the first shaft and the first end portion of the other upright member of the first pair to the second shaft;

said first and second support flanges each having an aperture opening at the first side and the second side, each of said apertures being defined by a surface, said first shaft first end portion being disposed in the aperture of the first support flange and slidably engaged with the aperture surface of the first flange, and said second shaft first end portion being disposed in the aperture of the second support flange and slidably engaged with the surface of the aperture of the second support flange, said first end of the first spindle overlying the opening of the aperture at the second side of the first support flange and closing the opening of the aperture at the second side of the first support flange, and said first end of the second spindle overlying the opening of the aperture at the second side of the second support flange and closing the opening of the aperture at the second side of the second support flange;

first and second support brackets each having first and second spaced apart sides and each having an aperture opening and said first and second spaced apart sides, said apertures being defined by a surface, and said first shaft second end portion being supportingly engaged with the aperture defining surface of the first support bracket, and said second shaft second end portion being supportingly engaged with the aperture defining surface of the second support bracket;

a first fastener connecting the first shaft second end portion to the first support bracket; and a second fastener connecting the second shaft second end portion to the second support bracket, said first and second fasteners maintaining said first and second shafts from movement along said axis and relative to said first and second support flanges.

11. The work vehicle, as set forth in claim 10, including a first passage disposed in said first shaft and opening at the first end of the first shaft;

a second passage disposed in the second shaft and opening at the first end of the second shaft, said first passage being adapted to pass pressurized fluid flow past the first end of the first shaft and to the aperture in said first support flange and said second passage being adapted to pass fluid flow past the first end of the second shaft and to the aperture in said second support flange.

12. The work vehicle, as set forth in claim 10, including:

a source of pressurized fluid flow;

means for passing pressurized fluid from said source to the aperture in said first and second support flanges, said first and second shafts being forcibly urged in a direction toward the first and second support brackets, respectively, in response to pressurized fluid being applied to the first end of said first and second shafts, respectively.

13. The work vehicle, as set forth in claim 12, wherein said passing means includes:

a first passage disposed in the first shaft and opening at the first end of the first shaft and at a location spaced from the first end of said first shaft;

a second passage disposed in the second shaft and opening at the first end of the second shaft and at a location spaced from the first end of the second shaft;

a first fitting having an inlet end portion and an outlet end portion and being connected at the outlet end portion to the first shaft at the location of said opening spaced from the first end of said first shaft;

a second fitting having an inlet end portion and an outlet end portion and being connected at the outlet end portion to the second shaft at the location of said opening spaced from the first end of said second shaft, said fittings being adapted to connect said source of pressurized fluid flow to said shafts and pass fluid from the source to said first and second passages.

14. The work vehicle, as set forth in claim 10, wherein said first means includes:

a first block having first and second sides, a bore opening at said first and second sides, and an end, said first block being connected at said end to the first end portion of said one upright;

a bearing disposed in the bore of said first block between the first shaft and first block, and said first block being located axially on said first shaft between the first flange and the first support bracket;

a second block having first and second sides, a bore opening at said second block, first and second sides, and an end, said second block being connected at said end to the first end portion of the other upright;

a second bearing disposed in the bore of the second block, said second bearing being disposed between the second block and second shaft, and said second block being located axially on said second shaft between the second support flange and the second support bracket.

15. A method for disconnecting a lift mast assembly from a work vehicle, including the steps of:

supporting the lift mast assembly;

removing a first fastener from connection with a first shaft and a first support bracket;

removing a second fastener from connection with a second shaft and a second support bracket;

connecting a source of pressurized fluid flow to a first fitting mounted on said first shaft;

directing pressurized fluid flow from said source to an aperture disposed through a first support flange closed at the first support flange second side by a first end of a first spindle and urging said first shaft to move in a direction substantially along an axis of the first shaft, toward said first support bracket, and to a location at which a first end portion of the first shaft is free from being disposed in said aperture and free from engagement with a surface defining said aperture;

connecting said source of pressurized fluid flow to a second fitting mounted on said second shaft;

directing pressurized fluid flow from said source to an aperture disposed through a second support flange closed at the second support flange second side by a first end of a second spindle and urging said second shaft to move in a direction substantially along an axis of the second shaft, toward said second support bracket, and to a location at which a first end portion of the second shaft is free from being disposed in the aperture of the second support flange and free from engagement with a surface defining said aperture; and removing the lift mast assembly from the work vehicle.

* * * * *